US007912239B2

(12) United States Patent
Nishimura et al.

(10) Patent No.: US 7,912,239 B2
(45) Date of Patent: Mar. 22, 2011

(54) FLAT SPEAKER

(75) Inventors: Takeshi Nishimura, Tokyo (JP); Masato Sorimachi, Tokyo (JP); Yuuzo Nakajima, Tokyo (JP); Hiroshi Ikeda, Tokyo (JP); Kiyoshi Ootani, Hyogo (JP); Akira Nishikawa, Hyogo (JP); Yuichi Nakajima, Hyogo (JP); Kiyosei Shibata, Hyogo (JP)

(73) Assignees: The Furukawa Electric Co., Ltd., Tokyo (JP); Fujitsu Ten Limited, Kobe-shi (JP)

( * ) Notice: Subject to any disclaimer, the term of this patent is extended or adjusted under 35 U.S.C. 154(b) by 1282 days.

(21) Appl. No.: 11/447,160

(22) Filed: Jun. 6, 2006

(65) Prior Publication Data

US 2006/0291688 A1 Dec. 28, 2006

(30) Foreign Application Priority Data

Jun. 6, 2005 (JP) ..... 2005-165802
Aug. 9, 2005 (JP) ..... 2005-230318

(51) Int. Cl.
*H04R 1/00* (2006.01)

(52) U.S. Cl. ..... 381/396; 381/397; 381/431

(58) Field of Classification Search ..... 381/396, 381/397, 408, 409, 410, 431
See application file for complete search history.

(56) References Cited

U.S. PATENT DOCUMENTS

| | | | | |
|---|---|---|---|---|
| 4,376,233 | A * | 3/1983 | Kamon et al. | 381/409 |
| 7,283,636 | B2 * | 10/2007 | Nishimura et al. | 381/152 |
| 2001/0048256 | A1 | 12/2001 | Miyazaki et al. | |
| 2005/0152577 | A1 | 7/2005 | Nishimura et al. | |

FOREIGN PATENT DOCUMENTS

| | | | |
|---|---|---|---|
| JP | 6-98396 | | 4/1994 |
| JP | 6-38400 | | 5/1994 |
| JP | 2001-333493 | | 11/2001 |
| JP | 2002-159082 | | 5/2002 |
| JP | 2002159082 | A * | 5/2002 |
| JP | 2003-284187 | | 10/2003 |
| WO | WO99/03304 | | 1/1999 |
| WO | WO 03/073787 | A1 | 9/2003 |

* cited by examiner

*Primary Examiner* — Curtis Kuntz
*Assistant Examiner* — Sunita Joshi
(74) *Attorney, Agent, or Firm* — Oblon, Spivak, McClelland, Maier & Neustadt, L.L.P.

(57) ABSTRACT

A flat speaker comprising a vibrating plate including a spiral voice coil, a lead portion extracted from the vice coil and reinforced by the reinforcing member, and an electric supply line; an edge portion supporting the vibrating plate; and a yoke, supporting the edge portion, on which the permanent magnet arranged to face the voice coil. The flat speaker 1 of the invention includes a vibrating membrane 2 of an insulating base film 3 with a spiral or meandering voice coil 4 formed on one or both faces thereof, a permanent magnet 5 arranged on corresponding location facing the voice coil 4; and a yoke 6 on which the permanent magnet 5 is arranged. The vibrating membrane 2 is avoided from hitting the permanent magnet by providing a perforated sheet on the back face of the yoke to control acoustic resistance.

6 Claims, 12 Drawing Sheets

FLAT SPEAKER

BACKGROUND OF THE INVENTION

1. Field of the Invention

The present invention relates to a thin-type flat speaker.

2. Description of the Related Art

Recently information terminals are developed to be mobile style, and required to be thin, downsized, and light weighted. In order to satisfy the requirement, a flat speaker has been developed. For example, the flat speaker is developed in corresponding to the needs for a liquid crystal display television, and automobile to be thinner and light weighted.

An electro-conductive flat speaker may be thinner and downsized in the construction in comparison with a corn type speaker. An example of the construction of a conventional flat speaker is described with reference to FIG. 2. FIG. 2 is a cross sectional view of the conventional flat speaker.

The flat speaker depicted in FIG. 2 includes a vibrating membrane 2 with a voice coil 4 provided on one face or both faces of an insulating base film 3, a plurality of permanent magnets 5, and yoke 6 for installing the permanent magnets 5. The vibrating membrane 2 is held to a frame 8 by an edge 7 thereof. The voice coil 4 is formed on the insulating base film 4 in a spiral or meandering shape.

The plurality of permanent magnets 5 are installed such that N poles and S poles of adjacent permanent magnets arranged with a prescribed space on the yoke 6 are reversed each other. Thus, the voice coil 4 is positioned to face the permanent magnet 5. More specifically, it is configured that magnetic field generated between the N pole and the S pole of the permanent magnet passes properly through the vice coil 4.

In the flat speaker 11 described above, there is a problem in which the amplitude of the vibrating membrane 2 becomes so large that the vibrating membrane 2 hits the permanent magnet 5, when the input power in the regeneration band in the vicinity of resonance frequency becomes large, thus generating noises or deteriorating the vibrating membrane 2.

A corn-type speaker has a means for controlling large amplitude of vibration which is for example a corrugation (i.e., damper or spider) of cloth impregnated with phenol resin. However, it is difficult to provide with the same kind of corrugation in the flat speaker.

There are disclosed that a buffering sheet is arranged (in Japanese patent application publication 2001-333493) or a damper is installed (in the publication WO99/03304) in order to control the generation of noises by the hitting of the vibrating membrane and permanent magnet, or avoiding the deterioration of the vibrating membrane 2. FIG. 2 shows an example of providing a buffering sheet 12.

The buffer sheet 12 is attached an opposite face of the magnetic pole to the yoke 6 of the permanent magnetic 5. An air gap provided between the buffer sheet 12 and the vibrating membrane 2 enables to avoid the sound generated by the contact of the vibrating membrane with the permanent magnetic 5, and further more to secure the free vibration of the vibrating membrane 2.

The Japanese Utility application publication Hei 6-38400 discloses that an acoustic resistance sheet is adhered to a hole provided in a center portion of a case in a piezoelectric receiver to give appropriate braking of an acoustic resistance so that the frequency characteristic is planarized.

Since the vibrating membrane is held only by the edge portion in the flat speaker, the resonance of the vibrating membrane per se becomes large Q value (peak degree of the resonance) of the acoustic pressure characteristic becomes excessively large such as 3 to 5, thus the vibrating membrane hits the magnet.

Accordingly, in order to control the input in a low tone range in the conventional flat speaker, the input voltage is designed to be small, or the low tone range is cut off by the capacitor.

However, when the input voltage is designed to be small or the low tone range is cut off by the capacitor in order to control the input of the low tone range, there is a problem in which an output of the favorable acoustic quality may not be obtained.

Japanese Patent application publication 2003-284187 discloses a flat speaker in which a drive power is generated in the entire face of the planar vibrating membrane so that plane waves are produced as a plane sound source and the phase thereof is flat. In addition, since a paper is not used as in the conventional corn type speaker, the flat speaker is excellent in heat resistance and humidity resistance, thus enabling to operate inwater. Also since each soundcell is small, an acoustic feedback hardly occurs. The flat speaker has a remarkable feature in which the thickness is very thin such as up to 1 cm, the weight is light, and the construction is very simple with small number of components.

FIG. 18 shows a cross sectional view of an example of another conventional flat speaker. The flat speaker 500 as shown in FIG. 18 includes a flat plate type yoke 501 formed by an iron plate (i.e., ferromagnetic metal plate) and a plurality of permanent magnet 503 fixed on one face of the yoke 501 with respective magnetic axes vertically placed. The permanent magnets 503 are arranged with a specific interval in a direction along the planer face of the yoke in such manner that polar characters of the adjacent magnets are reversed each other.

Furthermore, the flat speaker 500 includes an edge portion 505 having an arched portion 506 and jointed with a shelf portion 501*b* on a surrounding wall portion 501*a* of the yoke 501, and a vibrating plate 507 jointed by an adhesive material such as adhesive agent through the edge portion 505 and movably supported with a specific distance apart from the surfaces of the magnetic poles of the permanent magnet 503. FIG. 18 shows an edge portion 505 which is depicted with slanted lines.

The vibrating plate 507 is formed by an insulating base film or the like, and voice coils with at least one spiral forms in correspondence to the respective permanent magnets are formed on one or both faces of the vibrating plate 507. All the voice coils 509 are connected in such manner that currents flow in the same direction in the adjacent sides of the adjacent voice coils 509. A plurality of holes (not shown) are formed between the permanent magnets 503 in the yoke 501 in order to adjust an air pressure generated together with vibration of the vibrating plate 507. The lead portion 513 is extracted from the voice coil 509, and connected to the electric supply line 511 provided at the end portion of the lead portion 513.

FIG. 19 shows a plan view of the flat speaker 500. The edge portion 505 in a frame shape is jointed with the yoke 501 corresponding to the shape thereof, and the vibrating plate 507 is joined with the edge portion 505. Total of five voice coils in the longitudinal direction and three voice coils in the perpendicular direction are densely arranged in the same plane on the vibrating plate 507. A voltage is applied through an electric supply line to the voice coil.

Current flows through respective voice coils 509 of the flat speaker 500 to drive the vibrating plate 507 vertically upward and downward across thereof. The lead portion 513 is extracted from the voice coil 509, and connected to the electric supply line 515 provided at the end portion of the lead portion 513.

SUMMARY OF THE INVENTION

An object of the invention is to provide a flat speaker in which the disconnections in the lead portions of the voice coils hardly occur. Another object of the invention is to provide a flat speaker in which collision of the vibrating membrane to the permanent magnets is prevented without directly controlling the input of low tone range.

A first embodiment of the flat speaker of the invention comprises:

a vibrating membrane of an insulating base film with a voice coil formed thereon;

a permanent magnet arranged on corresponding location facing said voice coil;

a yoke on which said permanent magnet is arranged;

an edge portion supporting said vibrating membrane and said yoke to secure a space between said vibrating membrane and said permanent magnet; and a perforated sheet arranged in the space between said vibrating membrane and said permanent magnet at a location through which air passes.

In a second embodiment of the flat speaker of the invention, said yoke has an air hole, and said perforated sheet is arranged to cover the air hole of said yoke.

In a third embodiment of the flat speaker of the invention, said yoke has a flat portion in which the air hole is formed, and said perforated sheet is attached to a back face of the flat portion of said yoke to cover the air hole of said yoke.

In a forth embodiment of the flat speaker of the invention, said yoke has a flat portion in which the air hole is formed, and said perforated sheet is attached to an inner face of the flat portion of said yoke to cover the air hole of said yoke.

In a fifth embodiment of the flat speaker of the invention, said yoke has a flat portion in which the air hole is formed, and said perforated sheet is inserted into the air hole formed in said yoke.

In a sixth embodiment of the flat speaker of the invention, said perforated sheet is formed by at least one of perforated saran fiber net, non-woven fabric, cloth, Japanese paper and foam.

In a seventh embodiment of the flat speaker of the invention, said perforated sheet is a non-woven fabric having a weight of at least 40 g/m$^2$.

In an eighth embodiment of the flat speaker of the invention, rigidity of said vibrating membrane is improved by adding a member on at least a part of the insulating base film, providing a rib on at least a part of the insulating base film, forming at least a part of the insulating base film in three dimensions, or combining thereof.

Another embodiment of the flat speaker of the invention comprises:

a vibrating plate including a voice coil, a lead portion extracted from the voice coil, and an electric supply line provided at an end portion of the lead portion;

an edge portion supporting said vibrating plate;

a yoke on which a permanent magnet is arranged facing said voice coil, and supporting said edge portion; and a reinforcing member for reinforcing at least the lead portion of said vibrating plate.

In a tenth embodiment of the flat speaker of the invention, said reinforcing member comprises said edge portion.

In an eleventh embodiment of the flat speaker of the invention, said reinforcing member comprises a resin member.

In a twelfth embodiment of the flat speaker of the invention, said reinforcing member comprises an adhesive agent.

In a thirteenth embodiment of the flat speaker of the invention, said reinforcing member comprises a first reinforcing member to cover the lead portion and vicinity thereof, and a second reinforcing member extending longitudinally, said first reinforcing member and said second reinforcing member being symmetrically arranged.

In a fourteenth embodiment of the flat speaker of the invention, said reinforcing member covers the lead portion and vicinity of the lead portion.

In a fifteenth embodiment of the flat speaker of the invention, said reinforcing member covers the lead portion and vicinity of the lead portion including the voice coil.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE INVENTION

Figure 1:
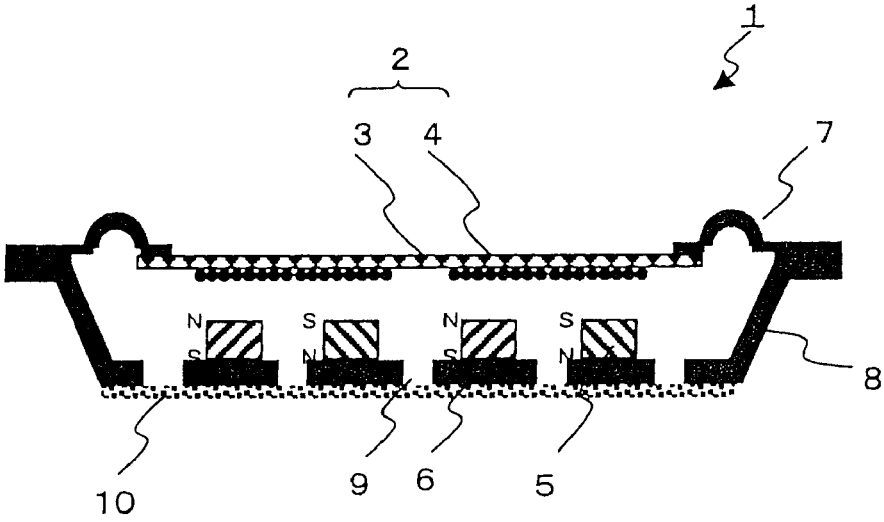
FIG. 1 is a schematic sectional view of the flat speaker of one of the embodiment of the invention.
Figure 2:
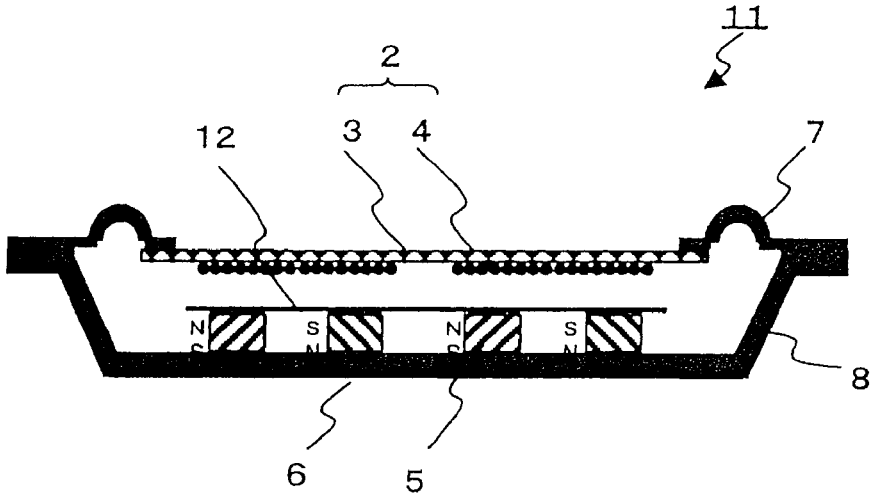
FIG.2 Background Art
FIG. 2 is a schematic sectional view of the conventional flat speaker.

Preferable embodiments of the flat speaker of the invention are described in detail with reference to the drawings. The same numeral reference is allocated to each component having the same function to simplify the description.

F*ig.*1 is a schematic sectional view of the flat speaker of one of the embodiment of the invention. Contour size of the flat speaker for example is 50 mm×80 mm.

A yoke 6 has a flat portion on which a plurality of permanent magnets are arranged 5. The plurality of permanent magnets are arranged apart with a specific distance each other and pole faces of the adjacent permanent magnets 5 are reversed each other.

A vibrating membrane 2 includes a plurality of spiral voice coils 4, and each voice coil 4 is arranged so as to face the pole face of the corresponding permanent magnet 5. The vibrating membrane 2 and the permanent magnet 5 are arranged in substantially parallel apart with a specific distance.

In this embodiment of the flat speaker, the vibrating membrane 2 has a plurality of spiral voice coils, however, it is not limited to the above feature. The voice coil may be formed in unity with the vibrating membrane. The vibrating membrane may be meandered and arranged on an insulating base film 3. In addition, the number of the permanent magnet 5 is not limited to plural.

In the above described flat speaker 1, air holes 9 are provided in the yoke 6, and a perforated sheet is attached to a back face of the yoke 6. Unwoven cloth, for example, is used as the perforated sheet 10.

When the vibrating membrane 2 vibrates in the flat speaker 1, the air positioned facing the vibrating membrane 2 vibrates together with the vibrating membrane to emit a sound, in addition, the air positioned backside of the vibrating membrane 2 also vibrates. The air holes 9 are formed in the yoke 6 so that the air positioned backside of the vibrating membrane 2 goes through the flat speaker 1.

Furthermore, the perforated sheet 10 is attached to the back face of the yoke 6 so that the air goes through the air holes in the yoke passes through the perforated sheet 10. In this embodiment, the perforated sheet 10 is attached to the back face of the yoke 6, however, not limited to the above. The perforated sheet 10 may be arranged in any other location to enable the air in the back face of the vibrating membrane to go through the vibrating membrane.

Figure 3:
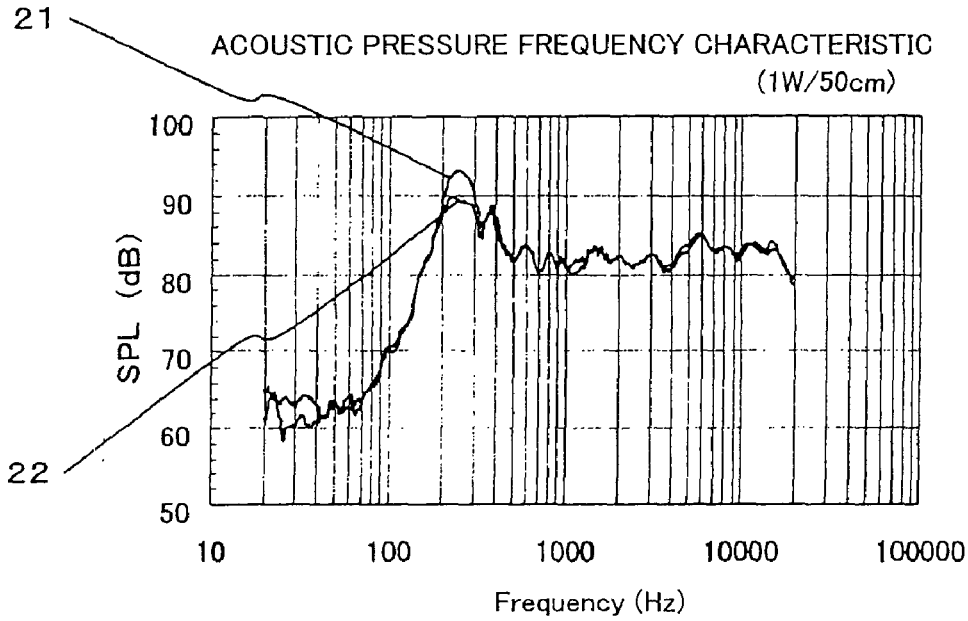
FIG. 3 is a graph showing one example of acoustic pressure frequency characteristics of the flat speaker of the invention.

One example of acoustic pressure frequency characteristics of the flat speaker of the invention described above is depicted in FIG. 3. In FIG. 3, the numeral reference 21 shows the acoustic pressure frequency characteristics of the conventional flat speaker without the perforated sheet 10, and the numeral reference 22 shows the acoustic pressure frequency characteristics of the flat speaker 1 of the invention with the perforated sheet 10 attached to the back face of the yoke 6.

As depicted in FIG. 3, the acoustic pressure frequency characteristics 22 of the flat speaker 1 with the perforated sheet 10 of the invention is relatively flat in a low frequency band compared with the acoustic pressure frequency characteristics 21 of the flat speaker without the perforated sheet sheet 10. In particular, the high peak appeared in the vicinity of resonance frequency in the flat speaker without the perforated sheet 10 is controlled in the flat speaker with the perforated sheet 10.

In the flat speaker 1 with the perforated sheet 10 attached to the back face of the yoke 6, the Q value is lowered from 4 to 2 without changing the resonance frequency. Accordingly, the hitting of the vibrating membrane to the permanent magnets can be controlled even in the case that the input power in the low frequency band is large, thus enabling to raise the input resistance from 10 w to 20 w.

Figure 4:
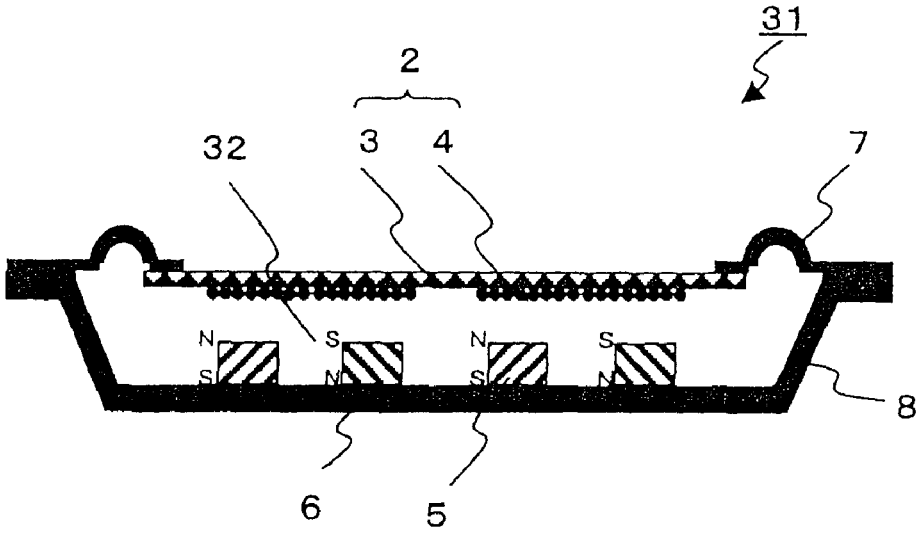
FIG.4 Background Art
FIG. 4 is a schematic sectional view of another conventional flat speaker.

In order to acknowledge the effect of the perforated sheet applied to the heat speaker 1 of the invention, acoustic pressure frequency characteristics concerning the flat speaker depicted in FIG. 4 are investigated with the volume of the back cabinet 32 in the flat speaker 31 varied. The result thereof is shown in FIG. 5.

As depicted in FIG. 4, the back cabinet 32 in the flat speaker 31 is the space defined by the vibrating membrane 2, the yoke 6 and the frame 8. When the volume of the back cabinet 32 is reduced, the effect of controlling the vibration amplitude is expected by the back-pressure of the vibrating membrane 2.

Figure 5:
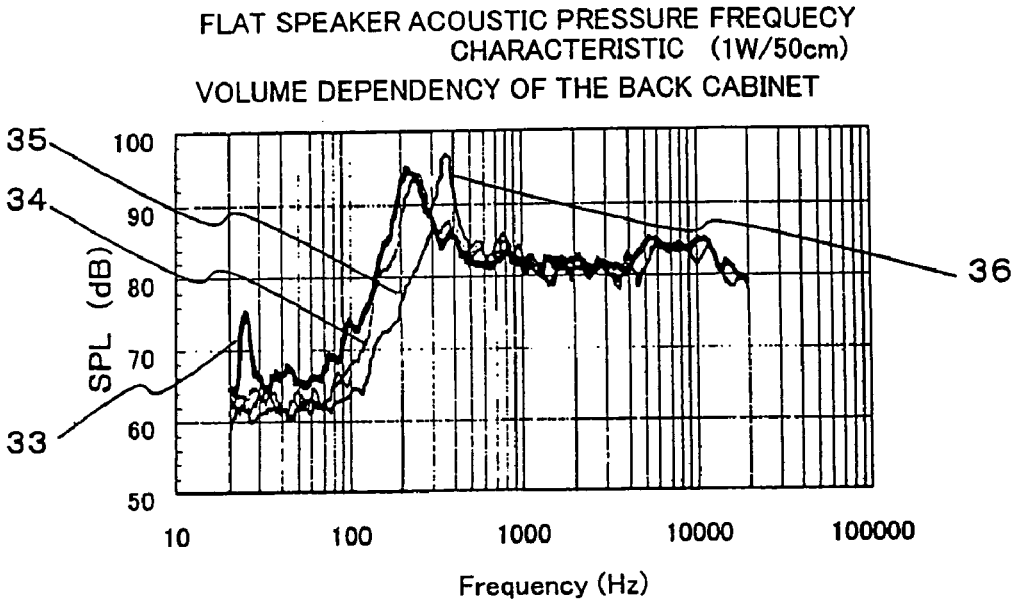
FIG. 5 is a graph showing one example of acoustic pressure frequency characteristics of the flat speaker of the invention when the capacity of the back cabinet is varied.

FIG. 5 shows the acoustic pressure frequency characteristics 33 in the flat speaker in which the air holes 9 are formed in the yoke 6 so that the air within the back cabinet 32 can goes away to the outside. However, the flat speaker does not have the perforated sheet different from the flat speaker of the invention. Thus, the peak of the acoustic pressure appears in the low frequency band.

The reference numerals 34 to 36 show respectively the acoustic pressure frequency characteristics of the flat speaker 1 with the air holes 9 formed in the yoke 6, as shown in FIG. 4. The volume of the back cabinet is reduced in 34, 35, 36 in this order.

Figure 6:
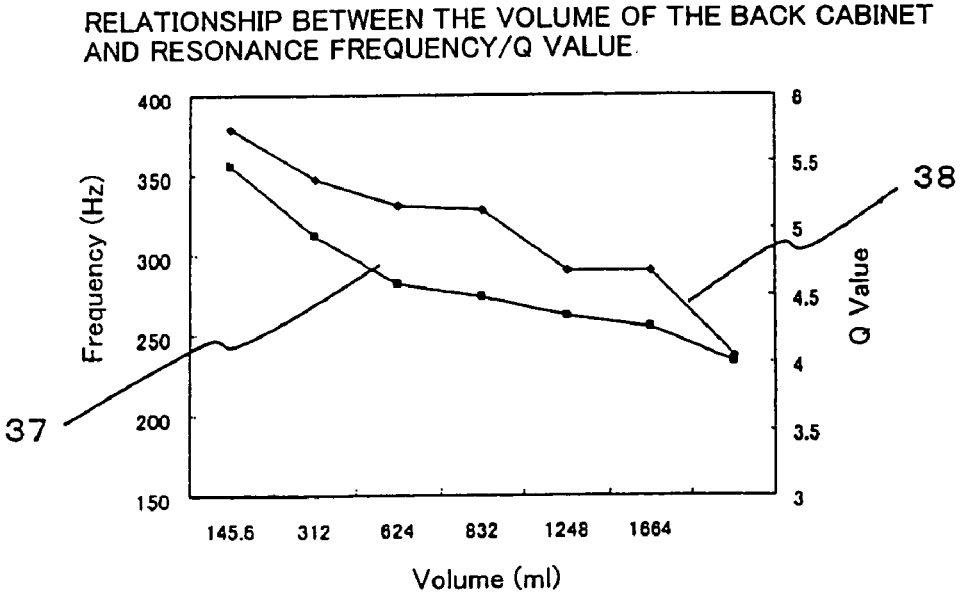
FIG. 6 is a graph showing one example of varied resonance frequency and Q value of the flat speaker of the invention when the capacity of the back cabinet is varied.

The volume of the back cabinet is reduced to increase the input resistance, however, resonance frequency and the Q value become large. FIG. 6 shows the variation of the resonance frequency 37 and Q value 38 when the volume of the back cabinet 32 is varied.

As shown in FIG. 6, it is understood that both of the resonance frequency 37 and the Q value 38 become large while the volume of the back cabinet 32 is reduced. Accordingly, it is not possible to obtain the same effect by the method of changing the volume of the back cabinet 32 as the effect obtained by attaching the perforated sheet 10 of the invention.

As another method to reduce Q value of the low frequency band, there is considered a method of softening the material of the edge 7. However, according to the method, the Q value is lowered together with the lowering the resonance frequency.

The method of softening the material of the edge 7 therefore does not lower the Q value without changing the resonance frequency, contrary to the flat speaker with the perforated sheet 10 of the invention There is considered another method of reducing the Q value in the low frequency band in which a sound-absorption material (10 mm thickness) for acoustics is arranged on the back face of the flat speaker. However, the Q value hardly varies according to the method.

There is considered further another method of reducing the Q value in the low frequency band in which the sound-absorption material for acoustics is arranged in the entire inner face of the back cabinet (the volume thereof is 1.6 liter). However, both of the Q value and resonance frequency becomes large according to the method.

As described above, it is acknowledged that the preferable acoustic pressure frequency characteristics of the resonance frequency and the Q value can be obtained only by the flat speaker 1 with the perforated sheet of the invention, and no other method are effective.

Figure 7A:
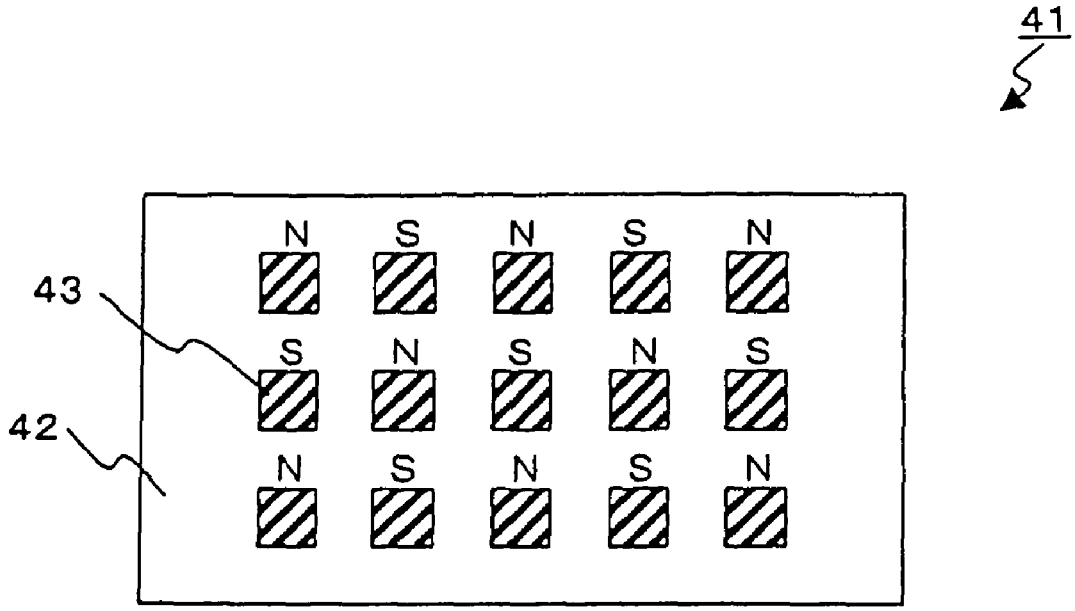
FIG. 7 is a view to explain the flat speaker of other embodiment of the invention, FIG. 7(*a*) is a plan view thereof, FIG. 7(*b*) is a cross sectional view thereof.
Figure 7B:
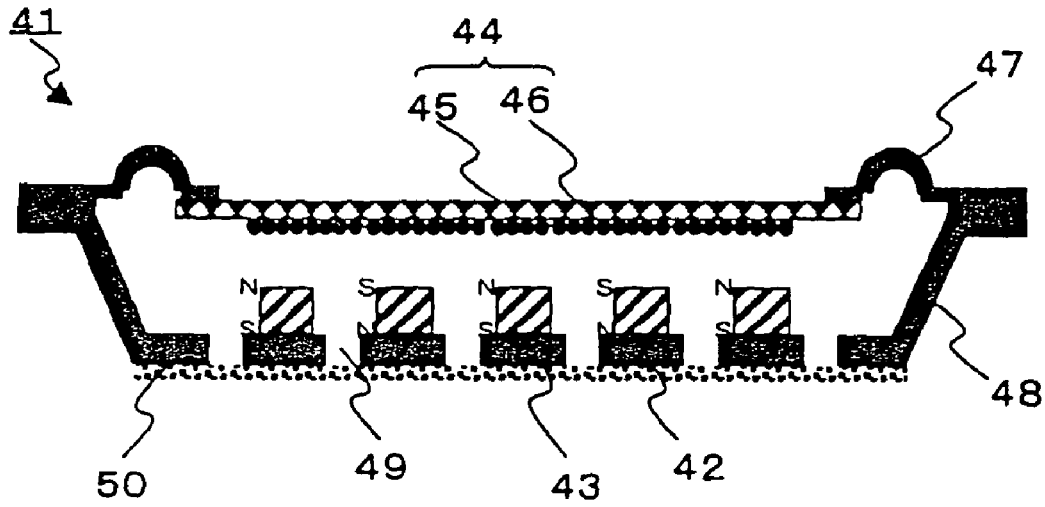

Another embodiment of the flat speaker of the invention is described with reference to FIG. 7. FIG. 7(*a*) is a plan view showing the flat speaker of the invention, and FIG. 7(*b*) is a cross sectional view showing the flat speaker of the invention.

The flat speaker 41 has a soft iron yoke 42 on which fifteen permanent magnets (three rows each having five pieces) are arranged. The size of the soft iron yoke 42 is 50 mm×90 mm×8 mm, and the size of the permanent magnet 43 is 7 mm×7 mm×2.4 mm, for example.

The vibrating membrane 44 includes a heat resistant base film 45 and a voice coil 46 meandered and formed on the heat resistant base film. The voice coil 46 is arranged above the permanent magnets to face the permanent magnets 43. The vibrating membrane 44 is adhered to be fixed to a frame 48 through an edge 47.

In other embodiment of the flat speaker of the invention, air holes are formed in the yoke 42, and an unwoven cloth as a perforated sheet is adhered to an entire back face of the yoke 42.

Figure 8:
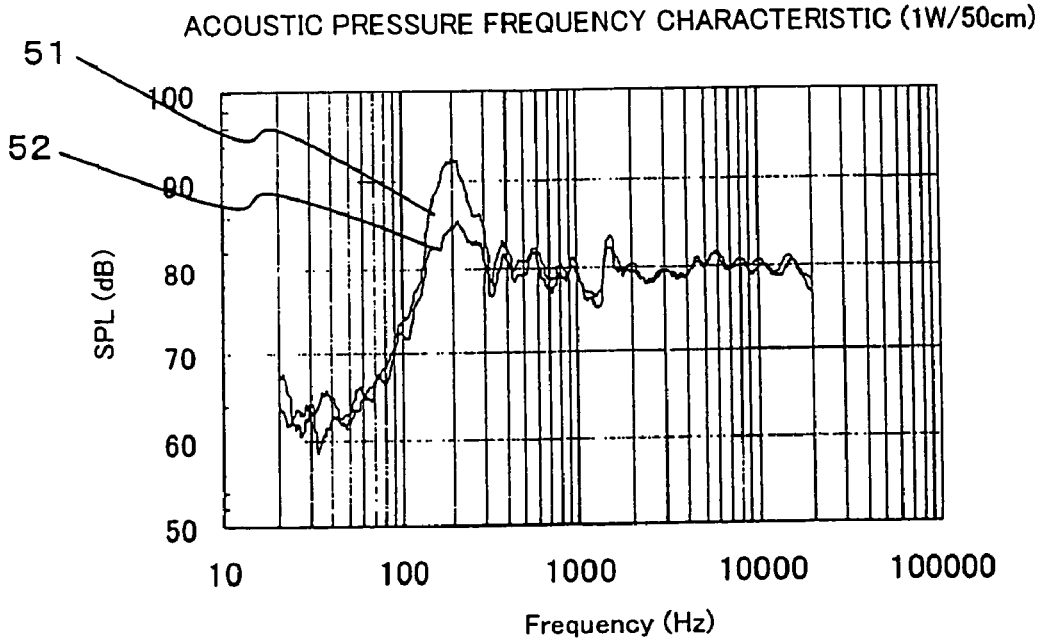
FIG. 8 is a graph showing one example of acoustic pressure frequency characteristics of the flat speaker of other embodiment of the invention.

FIG. 8 shows an example of acoustic pressure frequency characteristics of the flat speaker described above. In FIG. 8, the acoustic pressure frequency characteristic 51 is of the case in which the unwoven cloth 50 is not attached to the back face of the yoke 42, while the acoustic pressure frequency characteristic 52 is of the case in which the unwoven cloth 50 is attached to the back face of the yoke 42. As shown in FIG. 8, the acoustic pressure in the vicinity of resonance frequency of 190 Hz is lowered about 8 dB, and the acoustic pressures in other frequencies hardly change.

Figure 9:
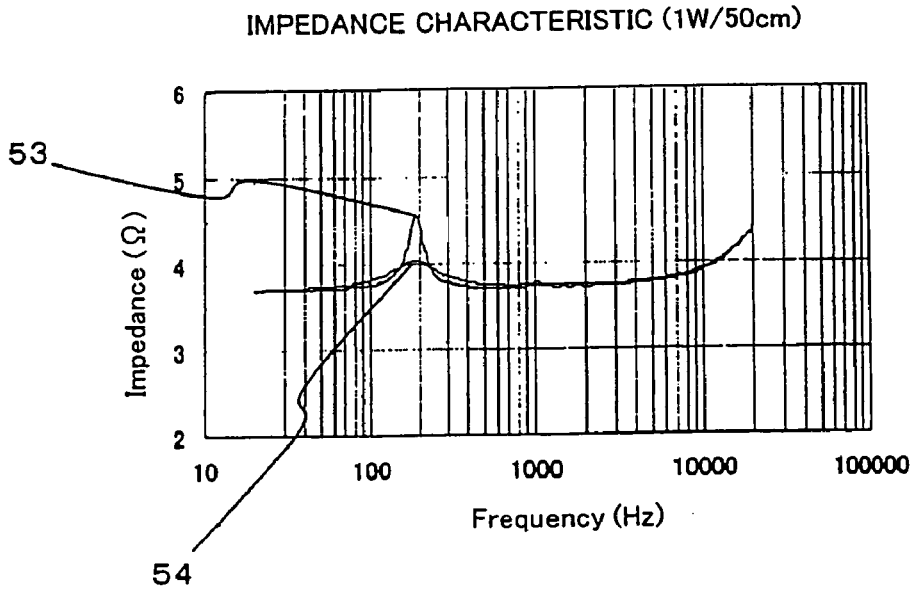
FIG. 9 is a graph showing impedance characteristics of the flat speaker of other embodiment of the invention.

FIG. 9 shows impedance characteristics of the flat speaker 41. FIG. 9 depicts comparatively the impedance characteristic 54 of the flat speaker 41 with the unwoven cloth adhered, and the impedance characteristic 53 of the flat speaker without the unwoven cloth adhered.

As shown in FIG. 9, the impedance characteristic is remarkably lowered in the vicinity of resonance frequency of 190 Hz in the same manner as the acoustic pressure frequency characteristic. The Q value calculated by the use of the impedance characteristic is 3.8 in the case of the flat speaker without the unwoven cloth adhered, and 1.3 in the case of the flat speaker with the unwoven cloth adhered, thus the amplitude in the vicinity of the resonance frequency is remarkably controlled.

Figure 10:
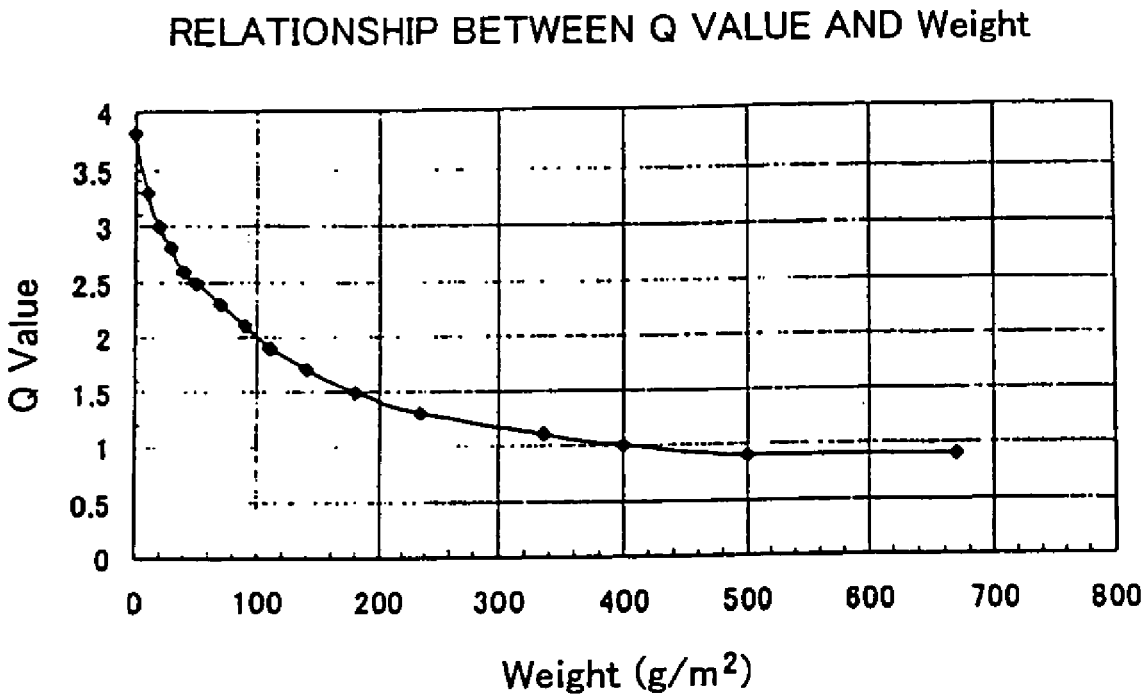
FIG. 10 is a graph showing a relationship between the weight of the unwoven cloth and Q value used in the flat speaker of the invention.

In the flat speaker 1, 41 of the invention, the unwoven cloth is used as the perforated sheet. FIG. 10 shows a relationship between the weight of the unwoven cloth and Q value.

As shown in FIG. 10, the weight of the unwoven cloth becomes large, as the Q value becomes small. Accordingly, it is recognized that the Q value can be lowered, when the weight of the unwoven cloth is set to be large. Furthermore, the above-mentioned effect does not appear in the region where the weight of the unwoven cloth is up to 40 g/m$^2$.

Figure 11:
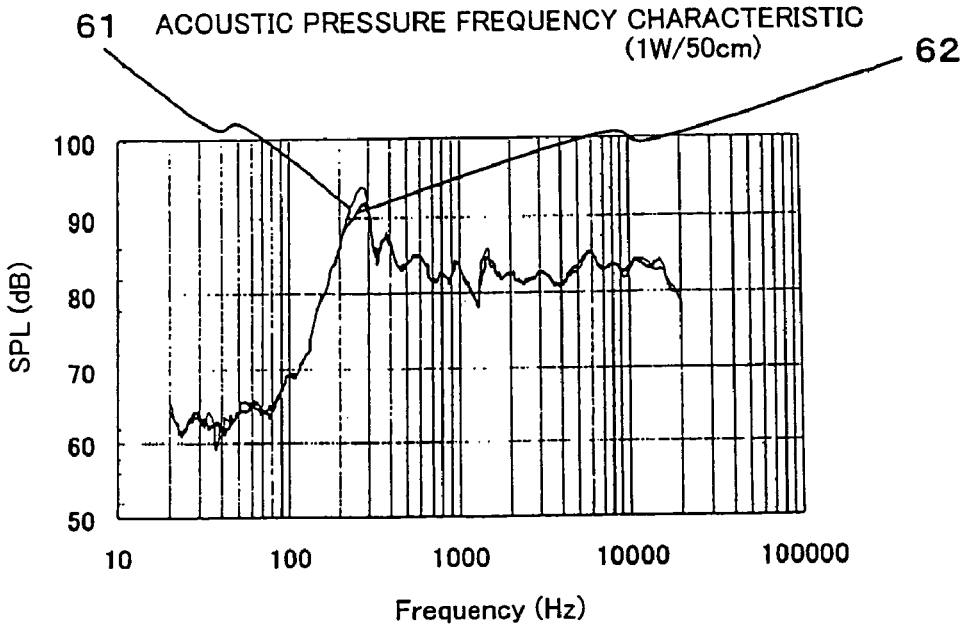
FIG. 11 is a graph showing acoustic pressure frequency characteristics when the unwoven cloth having a weight of 52 g/m$^2$ is attached.

FIG. 11 shows acoustic pressure frequency characteristics in the flat speaker when the unwoven cloth of 52 g/m$^2$ weight is attached. As shown in FIG. 11, the peak acoustic pressure in the vicinity of resonance frequency in the acoustic pressure frequency characteristics 62 with the unwoven cloth attached is lowered 2 dB (i.e., Q value is 2.5) compared with that in the acoustic pressure frequency characteristics 61 without the unwoven cloth attached, thus acknowledging the effect of attaching the unwoven cloth.

As the perforated sheet used in the flat speaker of the invention, in addition to the unwoven cloth described above, one of perforated material such as saran fiber net, cloth, Japanese paper, foam are applicable, or combined materials of those.

Figure 12:
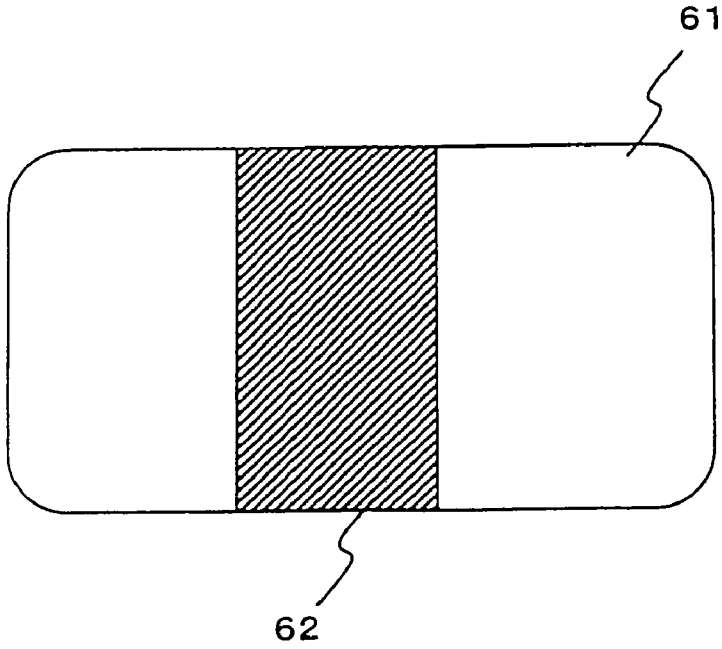
FIG. 12 is a schematic view to explain the way to improve rigidity of the vibrating membrane.

One of the other embodiments of the flat speaker of the invention is described hereunder. In this embodiment, rigidity of the vibrating membrane of the flat speaker is improved in order to lower Q value in the low frequency band. There is a method of improving rigidity of the vibrating membrane in which an aluminum foil is attached to the center portion of the vibrating membrane as shown in FIG. 12, for example. According to the above method, it is possible to lower the Q value without varying the resonance frequency.

One of the other embodiments of the flat speaker of the invention is described in detail with reference to FIGS. 13 to 17.

Figure 13:
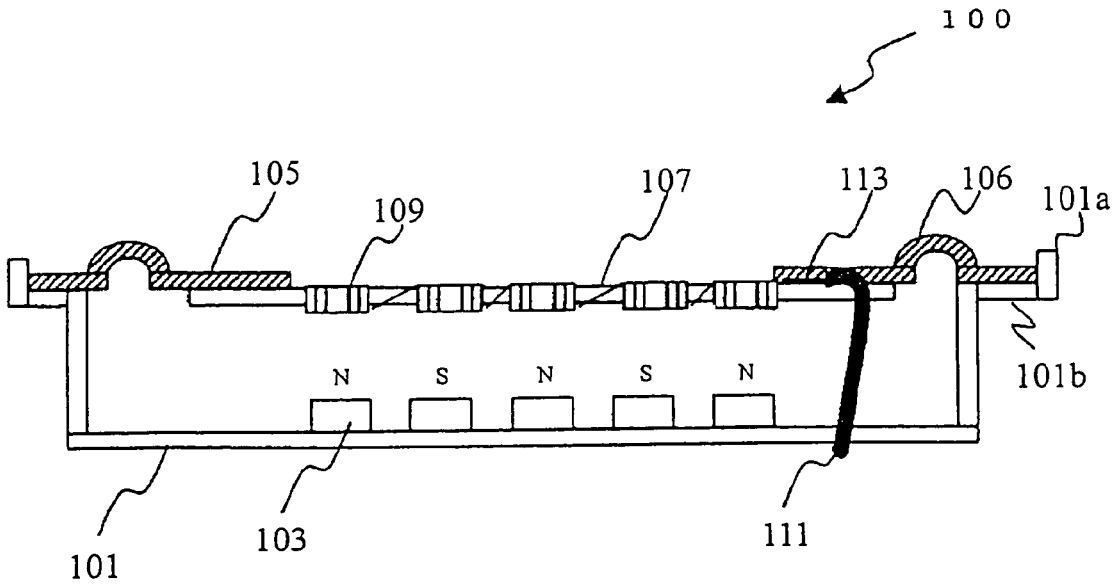
FIG. 13 is a schematic cross sectional view of the flat speaker of one embodiment of the invention.

FIG. 13 is a schematic cross sectional view of the flat speaker of one embodiment of the invention. Contour size of the flat speaker for example is 50 mm×90 mm×8 mm.

The flat speaker 100 depicted in FIG. 13 has a flat plate shaped yoke 101 made of soft iron steel plate (i.e., ferromagnetic metal plate), and a plurality of permanent magnets are arranged on the yoke. The plurality of permanent magnets 103 are arranged apart with a specific distance each other and pole faces of the adjacent permanent magnets 103 are reversed each other. The size of the permanent magnet is for example 7 mm×7 mm×2.4 mm.

The flat speaker 100 includes a frame shaped edge portion 105 having an arched portion and jointed with a shelf portion 101*b* on a surrounding wall portion 101*a* of the yoke 101, and a vibrating plate 107 jointed by an adhesive material such as adhesive agent through the edge portion 105 and movably supported with a specific distance apart from the surfaces of the magnetic poles of the permanent magnet 103.

The vibrating plate 107 includes at least one spiral voice coils 109. Each voice coil 109 is arranged to face the pole face of the respective permanent magnet 103. Each of the voice coils comprises a spiral shaped coil as described above. This is applicable to the other embodiments of the invention described hereunder. The vibrating plate 107 and the permanent magnet 103 are arranged to be in substantially parallel apart with a specific distance. The lead portion 113 is extracted from the voice coil 109, and connected to the electric supply line 115 provided at the end portion of the lead portion 113.

In this embodiment, the vibrating plate 107 has at least one spiral voice coils 109, however, the voice coil is not limited to the above. For example, the voice coil 109 may be integrally formed with the vibrating plate. Furthermore, the voice coil 109 is meandered and arranged on the insulating base film. Number of the permanent magnet 103 is not limited to a plural.

Figure 14:
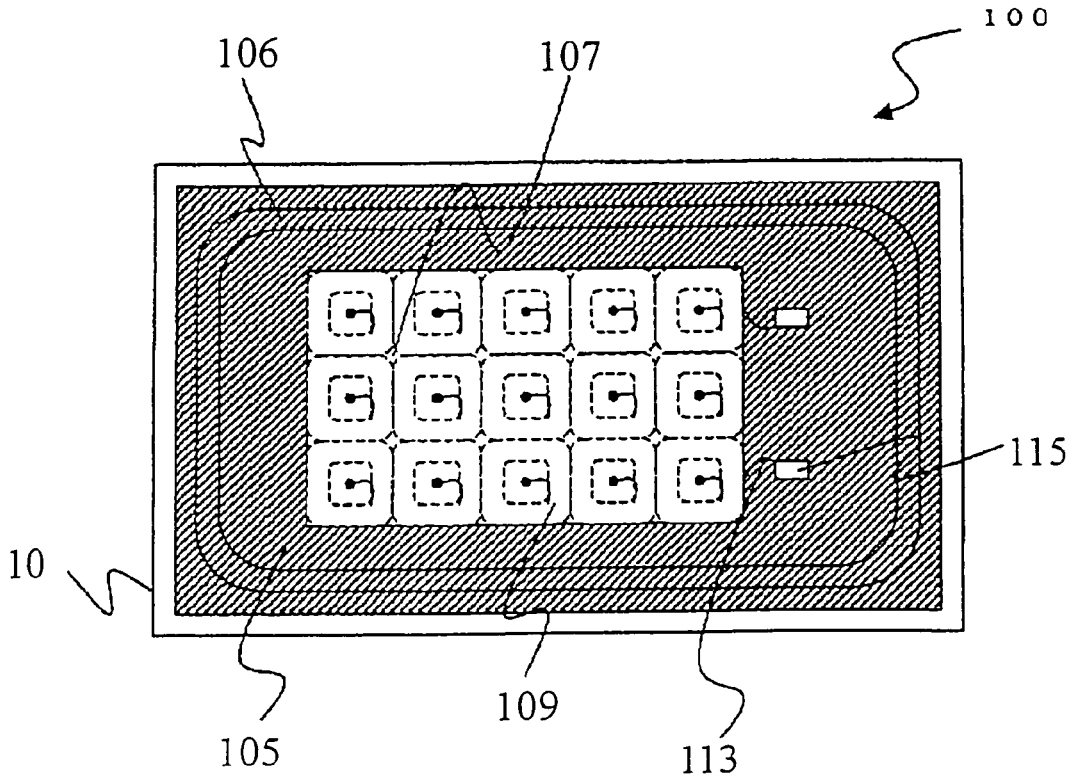
FIG. 14 is a schematic plan view of the flat speaker of one embodiment of the invention.

FIG. 14 is a schematic plan view of the flat speaker of one embodiment of the invention as depicted in FIG. 13. As shown in FIG. 14, the flat speaker 100 of this embodiment includes a vibrating plate 107 and a total of 15 (three rows of 5 voice coils) voice coils 109 arranged on both faces of the vibrating plate. As is clear from FIG. 14, in the flat speaker of this embodiment, a width of the edge portion 105 is extended to cover the portion of the vibrating plate 107. Thus, the lead portion 113 and the vicinity thereof are reinforced by the edge portion 105.

When the vibrating plate 107 vibrates in the flat speaker 100, the air positioned facing the vibrating plate 107 vibrates together with the vibrating plate to emit a sound, in addition, the air positioned back side of the vibrating plate 107 also vibrates. Air holes (not shown) are formed in the yoke 101 so that the air positioned backside of the vibrating plate 107 goes through the flat speaker 100.

The portion between an arched portion 106 of the edge portion 105 and the voice coil 109 is reinforced by the edge portion 107 and an adhesive agent adhering to fix the vibrating plate 107 to the edge portion 107, thus the lead portion 113 is reinforced.

A heat cycle test (i.e., thermal shock test) was carried out to the above-mentioned flat speaker of the invention while emitting a sound at a temperature range of −10 degree C. to 60 degree C. with 20 W electric energy applied thereto. As a result, the lead portion 113 does not come down after about 1000 hours in the flat speaker of the invention, while the lead portion came down after about 100 hours in the conventional flat speaker under the same condition.

Furthermore, one of the other embodiments of the flat speaker of the invention is described. The description about the same components of the flat speaker depicted in FIG. 13 is omitted.

Figure 15:
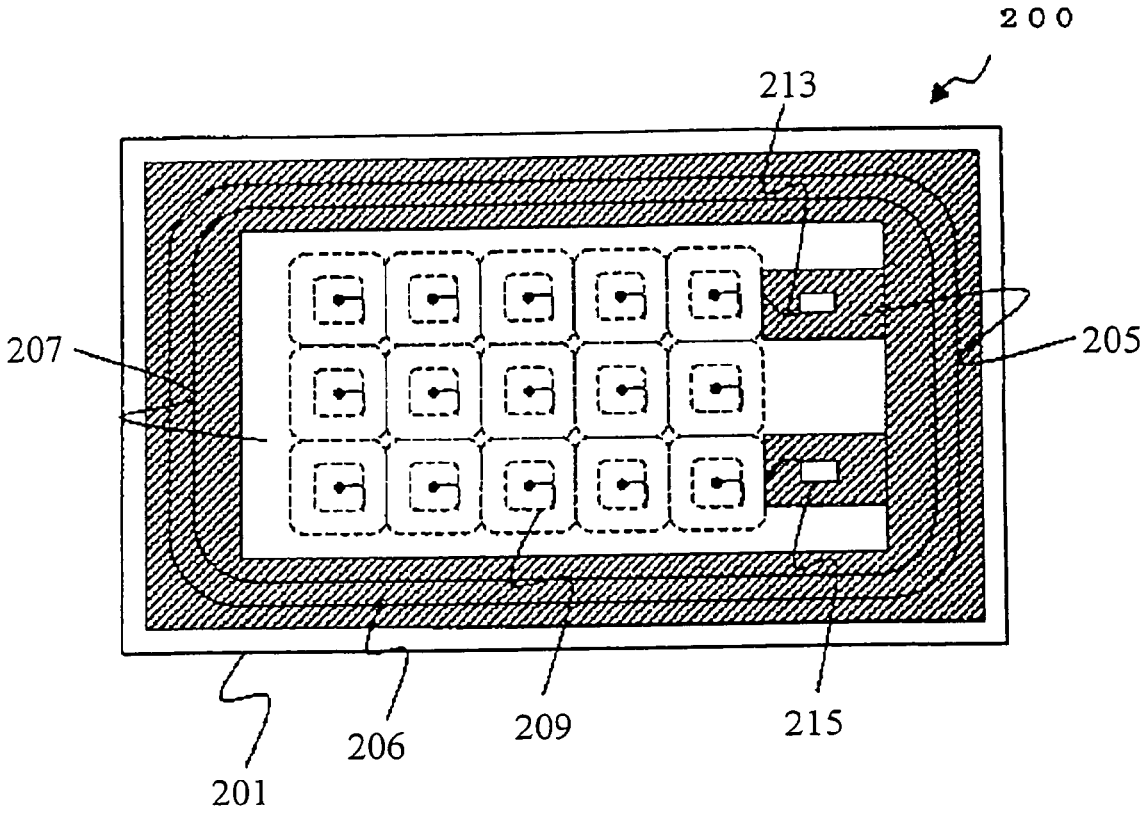
FIG. 15 is a schematic plan view of the flat speaker of one embodiment of the invention.

In the flat speaker 200 as depicted in FIG. 15, the width of the edge portion 205 is extended in a portion and the vicinity thereof of the vibrating plate 207 in which two lead portions 213 are positioned to reinforce the vicinity of the lead portions. The lead portion 213 is extracted from the voice coil 209, and connected to the electric supply line 215 provided at the end portion of the lead portion 213. In the flat speaker 100 as depicted in FIG. 13, the width of the entire edge portion 105 is extended in the portion including two lead portions 113 of the vibrating plate to reinforce the lead portions and the vicinity thereof. The increase of the weight of the edge portion may lower acoustic quality.

In this embodiment, only the portions of the edge portion in which two lead portions are positioned are extended so as to reduce the weight of the edge portion, thus avoiding the deterioration of the acoustic quality. The heat cycle test was carried out to the flat speaker of this embodiment under the same condition as the flat speaker as depicted in FIG. 13. As a result, the same effect is obtained.

Furthermore, one of the other embodiments of the flat speaker of the invention is described. The description about the same components of the flat speaker depicted in FIG. 13 is omitted.

Figure 16:
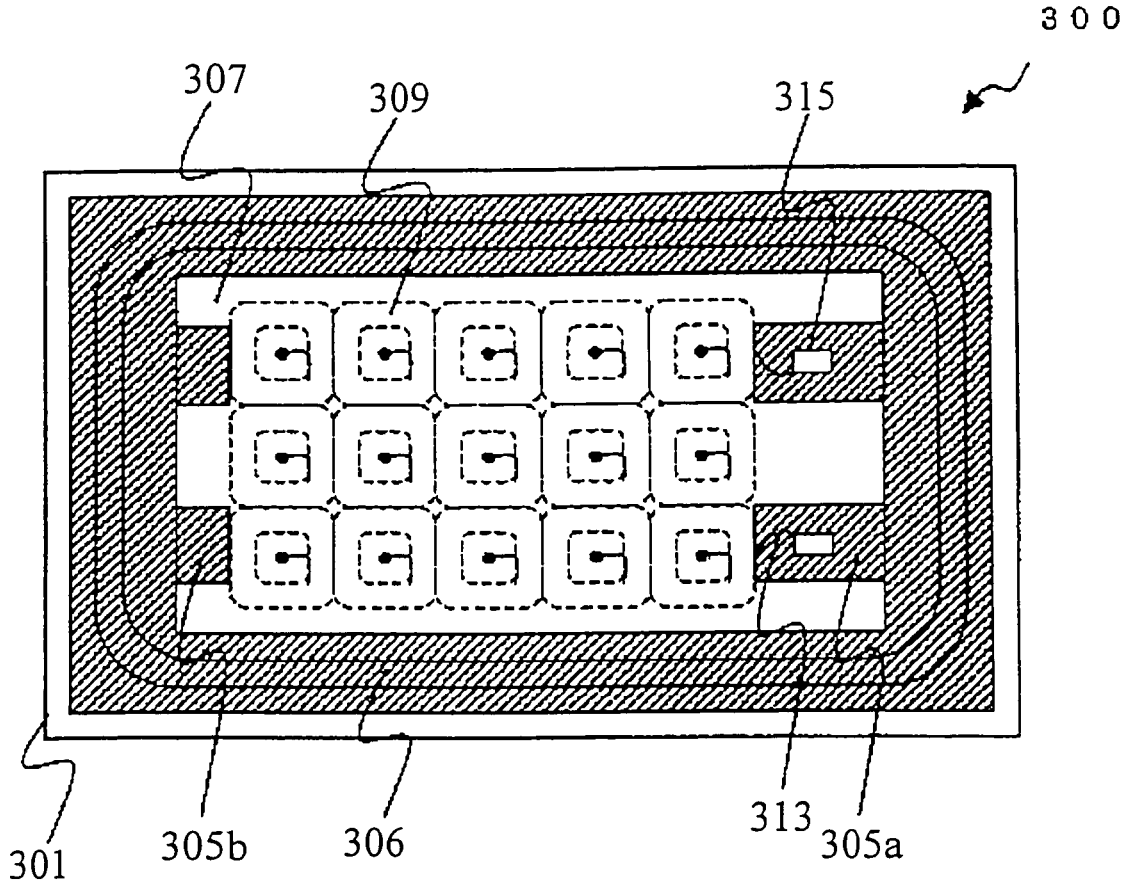
FIG. 16 is a schematic plan view of the flat speaker of one embodiment of the invention.

In the flat speaker 300 as depicted in FIG. 16, one end of the edge portion 305 is longitudinally extended to form first edge portions 305*a* in a portion and the vicinity thereof of the vibrating plate 307 in which two lead portions 313 are positioned, and the other end of the edge portion is longitudinally extended to form second edge portions 305*b* which are symmetrically positioned to the first edge portions 305*a* to reinforce the vicinity of the lead portions. The lead portion 313 is extracted from the voice coil 309, and connected to the electric supply line 315 provided at the end portion of the lead portion 313.

In the flat speaker as depicted in FIG. 15, only one end of the edge portion 205 is extended in a portion and the vicinity thereof of the vibrating plate 207 in which two lead portions 213 are positioned. Extended edge portions are not symmetric. The vibrating plate may not uniformly vibrate. Thus, not symmetrically extended edge portions may lower the acoustic quality. In this embodiment as depicted in FIG. 16, the one end of the edge portion is longitudinally extended to form the first edge portions in the portion and the vicinity thereof of the vibrating plate 307 in which two lead portions 313 are positioned, and the other end of the edge portion is longitudinally extended to form second edge portions 305*b* which are symmetrically positioned to the first edge portions 305*a*. Thus, symmetrically extended edge portions avoid deterioration of the acoustic quality. The heat cycle test was carried out to the flat speaker of this embodiment under the same condition as the flat speaker as depicted in FIG. 13. As a result, the same effect is obtained.

Furthermore, one of the other embodiments of the flat speaker of the invention is described. The description about the same components of the flat speaker depicted in FIG. 13 is omitted.

Figure 17:
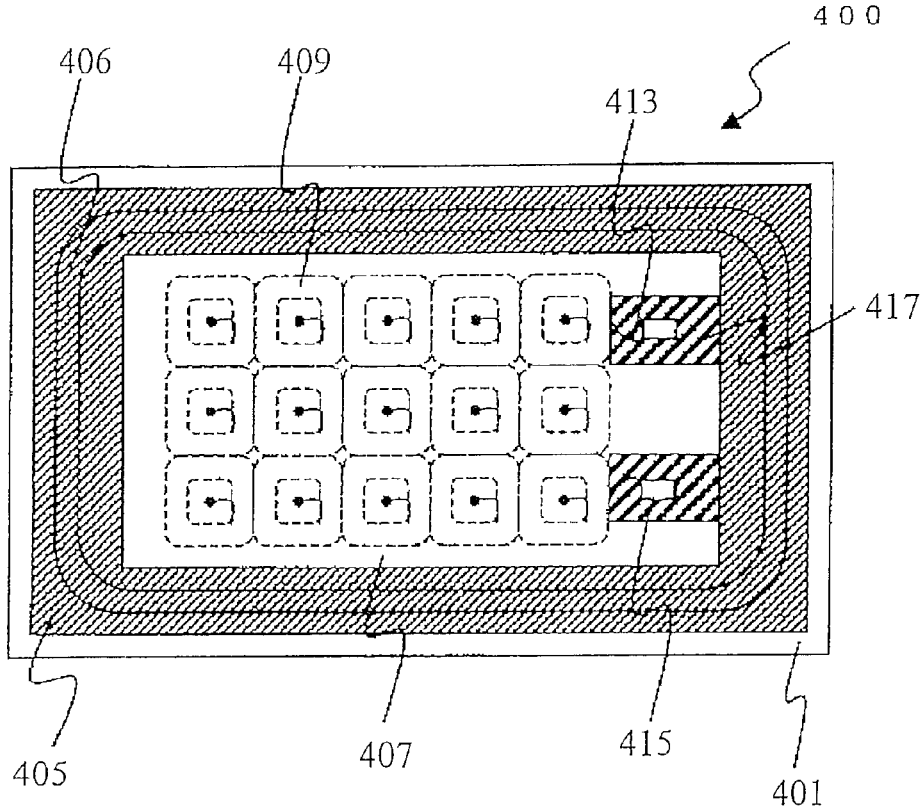
FIG. 17 is a schematic plan view of the flat speaker of one embodiment of the invention.
Figure 18:
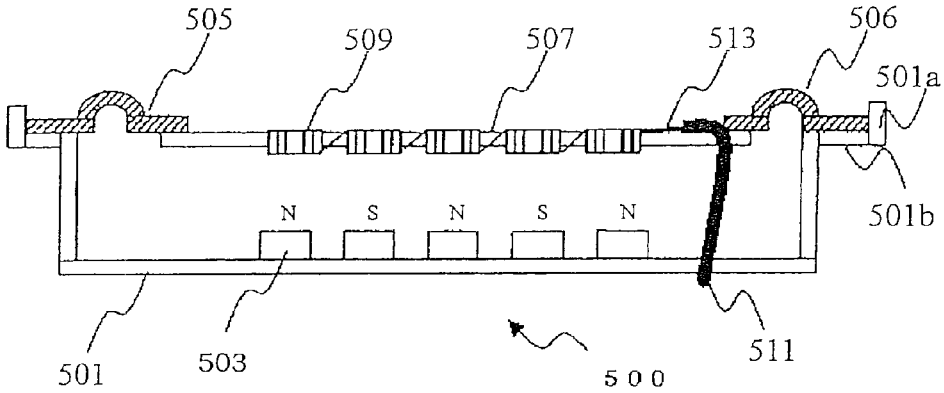
FIG.18 Background Art
FIG. 18 is a schematic cross sectional view of the conventional flat speaker.
Figure 19:
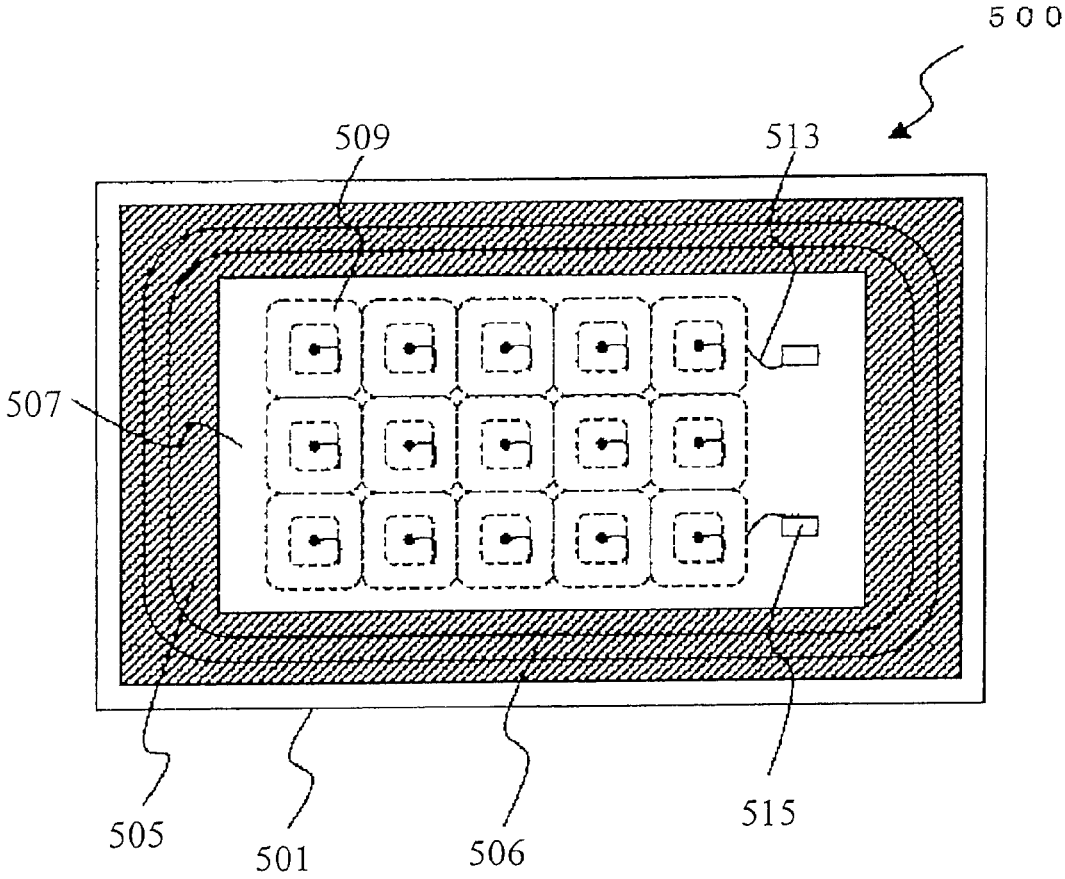
FIG.19 Background Art
FIG. 19 is a schematic cross sectional view of the conventional flat speaker.

In the flat speaker as depicted in FIG. 17, a soft, light-weight, heat resisting plastic material such as a hyperfine expanded sheet, MCPET (registered trademark) or the like is arranged in the portion of the vibrating plate 407 in which two lead portions 413 are positioned, or adhesive agent is attached thereto to reinforce the vicinity of the lead portions. The lead portion 413 is extracted from the voice coil 409, and connected to the electric supply line 415 provided at the end portion of the lead portion 413.

The flat speaker of this embodiment reinforces the same portions as that of the embodiment depicted in FIG. 15, and realizes a light-weight flat speaker compared to the above mentioned embodiments. Furthermore, when a soft, light-weight, heat resisting material is used in place of the extended edge portions 305 as depicted in FIG. 16, it is possible to further reinforce the portions than the embodiment as depicted in FIG. 15. The heat cycle test was carried out to the flat speaker of this embodiment under the same condition as the flat speaker as depicted in FIG. 13. As a result, the same effect is obtained.

In the flat speaker of the embodiments depicted in FIGS. 13 to 17, the reinforcing portions including extended edge portions may involve the voice coils. When the voice coils are involved in the reinforcing portions, the stress generated in the lead portions during the vibration of the vibrating plate can be avoided so as to improve reliability of the lead portions.

Furthermore, the number of the voice coils in the flat speaker is decided according to the design, and is not limited to any specific number. The present invention is not limited to the above-described embodiments, and can be modified in various manners within the scope of the spirit of the invention.

As described above, the stress is not concentrated in the lead portion so as to avoid breaking when the lead portion is fixed by the reinforcing member in the flat speaker of the invention. Furthermore, the vibrating plate can be light-weighted and the acoustic quality can be avoided from lowering by using various type or shape of the reinforcing member.

As described above, according to the present invention, the Q value of the flat speaker with no damper can be lowered without directly controlling the input power of the low tone, and can avoid the vibrating membrane from hitting the permanent magnets in reproduction band in the vicinity of the resonance frequency.

Thus, the stress is not concentrated in the lead portion so as to avoid breaking when the lead portion is fixed by the reinforcing member in the flat speaker of the invention, and so the flat speaker of the invention enables the industrial application.

The present invention is not limited to the above described embodiments, and various variations and modifications may be possible without departing from the scope of the present invention.

This application is based on the Japanese Patent applications No. 2005-165802 filed on Jun. 6, 2005 and No. 2005-230318 filed on Aug. 9, 2005, entire content of which is expressly incorporated by reference herein.

What is claimed is:

1. A flat speaker comprising:

a vibrating membrane of an insulating base film with a voice coil formed thereon;

a permanent magnet arranged on a corresponding location facing said voice coil;

a yoke having a top surface on which said permanent magnet is arranged;

an edge portion supporting said vibrating membrane and said yoke to secure a space between said vibrating membrane and said permanent magnet; and a perforated sheet arranged at a location through which air in the space between said vibrating membrane and said permanent magnet passes, wherein said yoke has an air hole, and said perforated sheet is arranged to cover the air hole of said yoke and attached to a bottom surface of the yoke opposite the top surface.

2. The flat speaker according to claim 1, wherein said yoke has a flat portion in which the air hole is formed, and said perforated sheet is attached to an inner face of the flat portion of said yoke to cover the air hole of said yoke.

3. The flat speaker according to claim 1, wherein said yoke has a flat portion in which the air hole is formed, and said perforated sheet is inserted into the air hole formed in said yoke.

4. The flat speaker according to claim 1, wherein said perforated sheet is formed by at least one of perforated saran fiber net, non-woven fabric, cloth, Japanese paper and foam.

5. The flat speaker according to claim 1, wherein said perforated sheet is a non-woven fabric having a weight of at least 40 $g/m^2$.

6. The flat speaker according to claim 1, wherein rigidity of said vibrating membrane is improved by adding a member on at least a part of the insulating base film, providing a rib on at least a part of the insulating base film, forming at least a part of the insulating base film in three dimensions, or combining thereof.

* * * * *